US005735723A

United States Patent [19]

von Oppen

[11] Patent Number: 5,735,723

[45] Date of Patent: Apr. 7, 1998

[54] TOY BLOCKS HAVING NATURAL SHAPES

[76] Inventor: Karl von Oppen, 21103 Mulholland Dr., Woodland Hills, Calif. 91364

[21] Appl. No.: 790,562

[22] Filed: Jan. 29, 1997

Related U.S. Application Data

[60] Provisional application No. 60/010,748 Jan. 29, 1996.

[51] Int. Cl.[6] ..... A63H 33/04

[52] U.S. Cl. ..... 446/85; 446/117; 446/491

[58] Field of Search ..... 446/85, 117, 480, 446/491; D30/160; 119/28.5, 706; 52/313; 428/15, 18

[56] References Cited

U.S. PATENT DOCUMENTS

| | | | |
|---|---|---|---|
| D. 161,318 | 12/1950 | Cooper | 428/18 |
| 1,483,570 | 2/1924 | Brown | 428/18 |
| 2,508,959 | 5/1950 | Marino | 428/18 |
| 2,590,676 | 3/1952 | Bradley | 446/480 |
| 4,224,881 | 9/1980 | Berry | 428/18 |
| 4,272,908 | 6/1981 | Bassetti et al. | 446/480 |
| 4,594,950 | 6/1986 | Morris | 428/18 |
| 4,639,234 | 1/1987 | Atwood | 446/476 |
| 5,118,539 | 6/1992 | Sebby et al. | 428/18 |

FOREIGN PATENT DOCUMENTS

| | | | |
|---|---|---|---|
| 563693 | 6/1957 | Italy | 428/18 |

OTHER PUBLICATIONS

Bob Thaves, "Frank & Ernest" cartoon, Washington Post, p. E16, Dec. 15, 1984.

*Primary Examiner*—Robert A. Hafer
*Assistant Examiner*—Jeffrey D. Carlson
*Attorney, Agent, or Firm*—Timothy T. Tyson; Ted Masters

[57] ABSTRACT

A set of blocks cut from the limbs and trunks of small trees is shown for making natural appearing stacks (20, 60). Each block has parallel upper and lower cuts (82, 84, 170, 171) across the blocks spaced a predetermined increment "I" or a multiple of increment "I" from each other. The remaining outer surfaces (90, 92) remain in their natural states complete with bark, protrusions, and other anomalies.

24 Claims, 9 Drawing Sheets

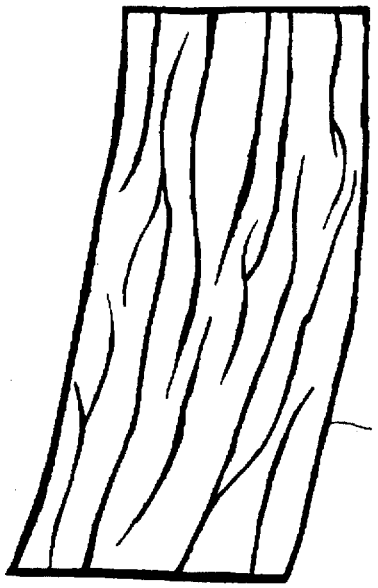
FIG. 9
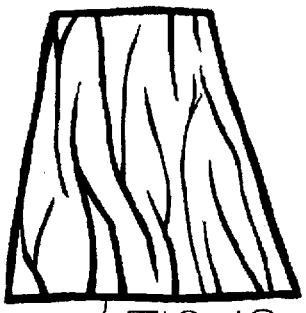
FIG. 10
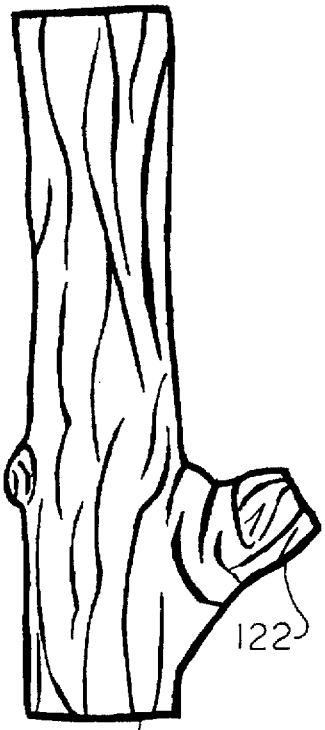
FIG. 11
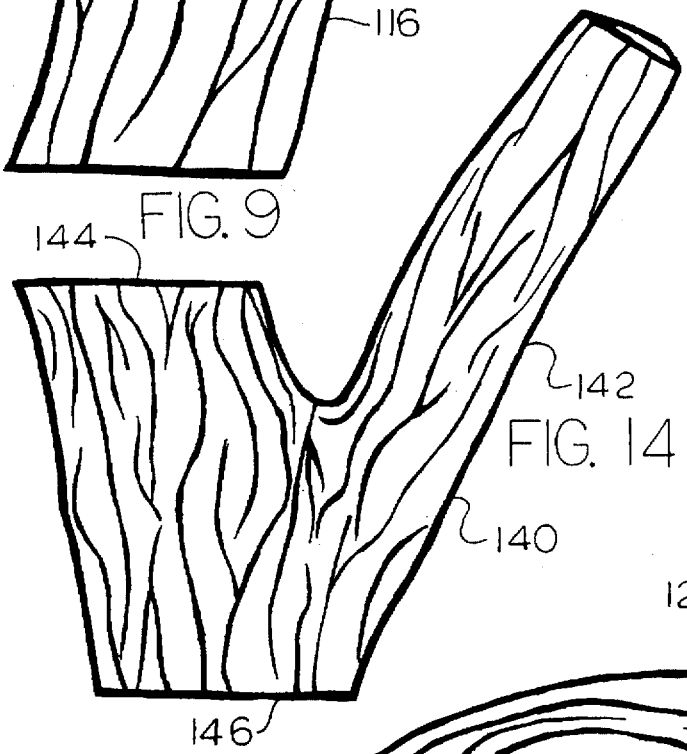
FIG. 14
FIG. 12
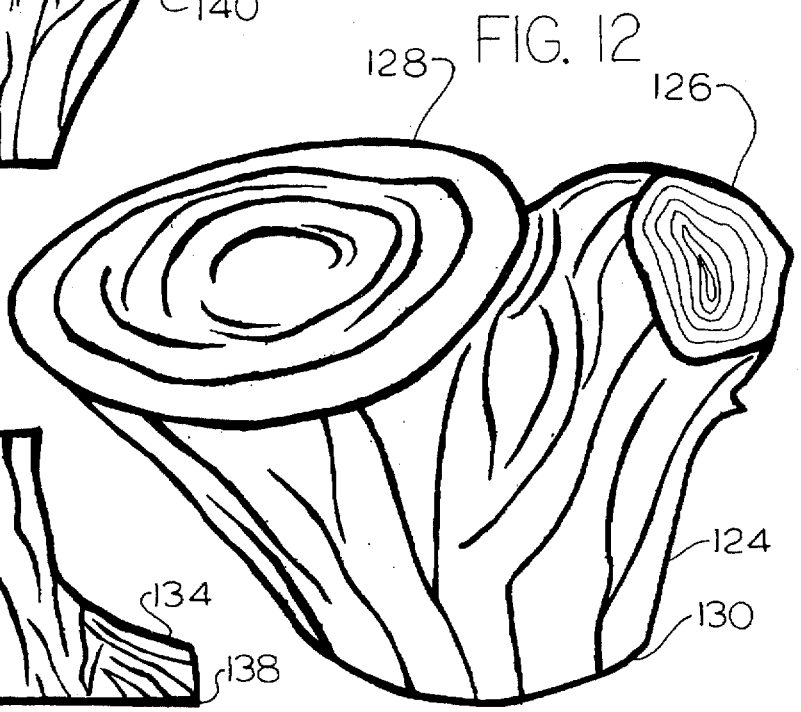
FIG. 13
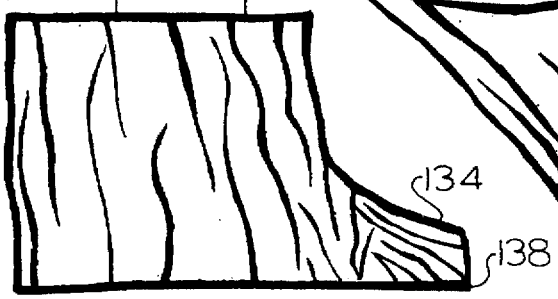

FIG. 23
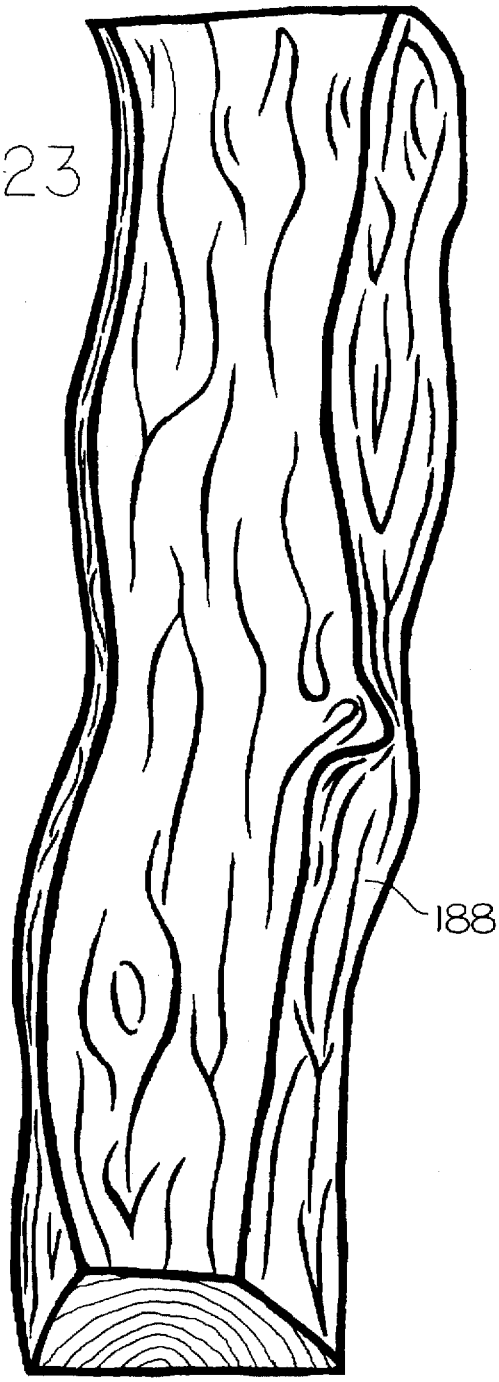
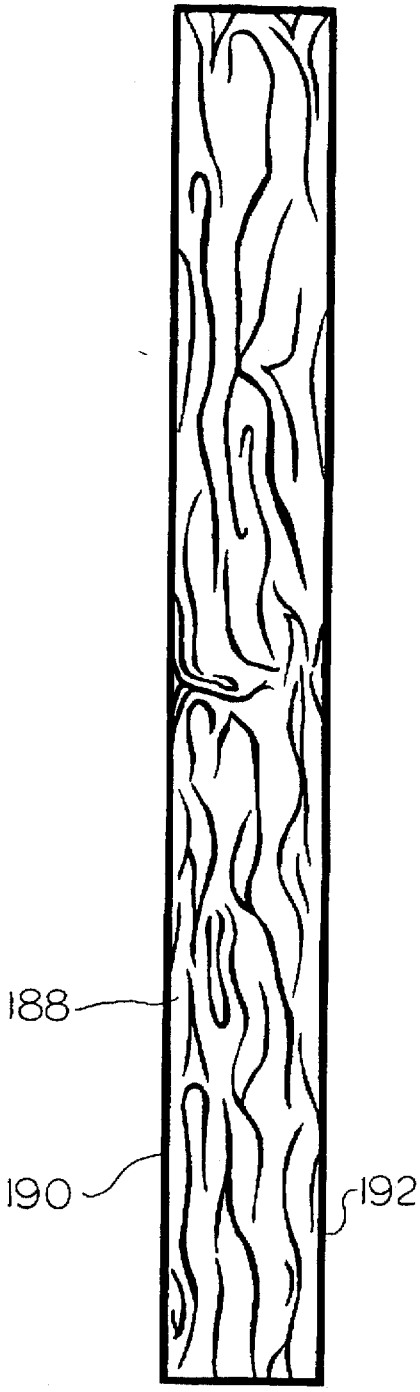
FIG. 24
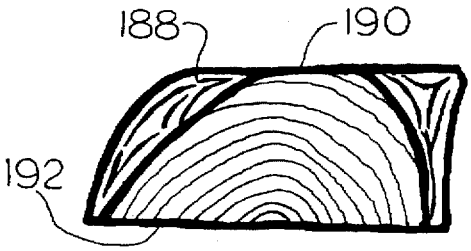
FIG. 25

TOY BLOCKS HAVING NATURAL SHAPES

CROSS REFERENCE TO RELATED APPLICATION

This application claims the benefit under 35 U.S.C. §119(e) of U.S. Provisional Application Ser. No. 60/010,748, filed on Jan. 29, 1996, the contents of which are incorporated herein by reference.

TECHNICAL FIELD

The present invention pertains to toy blocks, and in particular to tree blocks fabricated from portions of small tree limbs and trunks cut to standardized increments and molded copies of such blocks.

BACKGROUND ART

Currently available plastic or wood toy blocks are fabricated to look like miniature building components and not pieces of trees. They have standardized dimensions allowing them to be fit together in the manner of bricks. Wood blocks tend to be rectangular or cylindrical solids. Wood blocks sold under the Lincoln Logs trademark are a popular variation and are cylindrical with notches in the ends for holding them together at right angles in the manner of pioneer log cabins. A similar set based on rectangular components is shown in U.S. Pat. No. 2,110,990. A further modification is seen in U.S. Pat. No. 1,562,006. Wood toy block sets only have limited variations of types of blocks.

Most toy block sets also usually have only limited variations of types of blocks. However, their variations not limited by the underlying nature of wood and difficulty of working with wood. For example, plastic block sets are sold under the Lego trademark by Interlego A.G. of Baar, Switzerland, have many variations for the construction of specialized projects. Many of the pieces have limited utility outside of the specialized project. For example, specialized plastic "blocks" for making trees are seen in U.S. Design Pat. Nos. D 314,989; D 317,479; and D 338,928. They have virtually no utility outside of making specific model trees by the addition of leaves and limbs on the scale of the special projects for which they have been designed. Another special Lego block for making a roof is shown in U.S. Design Pat. No. D 315,580.

Other unusual building blocks having humanoid shapes are noted in U.S. Design Pat. Nos. D 143,272 and D 326,486. Both of these are used with other identical blocks to construct limited formations.

U.S. Pat. No. 2,278,327 discusses the cutting of block pieces to dimension in multiples of "U" a basic horizontal unit of measure. This patent is representative of the fact that it is common to have blocks with different horizontal multiples of a basic unit in a single set.

U.S. Pat. Nos. 3,863,918 and 5,221,223 show special angular construction blocks which can be used to create a variety of modern artistic formations.

None of the prior art blocks use or suggest ways of using natural portions of small trees. The use of these portions is normally as firewood. Such wood has been available for time immemorial and has even been collected by children and played with by them for a similar period of time but not as stacking blocks because it was impossible to use the pieces as blocks.

DISCLOSURE OF INVENTION

The present invention provides sets of toy "blocks" fabricated from portions of small tree limbs and trunks for use by children. No two blocks are identical because they are made from natural sources. While these blocks may be a challenge from the manufacturing point of view, they have a very natural and unique appearance.

The problem is how to make thousands of different portions of small tree trunks and limbs work together as building "blocks" and yet remain natural looking. The solution is in making two saw cuts substantially parallel to each other spaced a length or width from each other a preselected increment "I" or multiple of "I." All other surfaces remain in their natural states. Some blocks may be sections cut across the grain of the wood while others may be cut at angles to the grain of the wood or along the grain of the wood.

In accordance with a preferred embodiment of the invention, each block has a plurality of natural surfaces created by the tree and only two planar cut surfaces for stacking purposes.

In accordance with a preferred embodiment of the present invention, the blocks may alternately be fabricated of plastic with each block having a plurality of surfaces molded and/or painted to look like the natural surfaces created by a tree.

In accordance with an important feature of the invention, the block is a cylinder with a protuberance passing through the plane of one of the two planar cut surfaces. In accordance with an important aspect of the invention, the protuberance is cut by one of the two planar cut surfaces making it also useful for stacking purposes.

In accordance with a feature of the invention, the the block is a cylinder with the two planar cut surfaces at an angle to the grain of the block. The block is thereby weighted to one side increasing the challenge of stacking it with others.

In accordance with an aspect of the invention, the block is a forked block having at least two forks with one of the two planar cut surfaces cutting across the at least two forks. In accordance with an important aspect of the invention, the forked block has three forks with one of the two planar cut surfaces cutting across all three forks.

Other features and advantages of the present invention will become apparent from the following detailed description, taken in conjunction with the accompanying drawings, which illustrate, by way of example, the principles of the invention.

BRIEF DESCRIPTION OF DRAWINGS

FIG. 9 is a side elevation view of a cylindrical block having a curved body;

FIG. 10 is a side elevation view of a cylindrical block having a truncated cone body shape;

FIG. 11 is a side elevation view of a cylindrical block having a large protuberance to one side;

FIG. 12 is a perspective view of a cylindrical block cut at an angle to the grain of the wood and having a large non-interfering protuberance to one side;

FIG. 13 is a side elevation view of a cylindrical block having a large protuberance cut by the lower cut;

FIG. 14 is a side elevation of a cylindrical block having a large uncut side fork;

FIG. 23 is a perspective view of a plank type of block;

FIG. 24 is a side elevation of FIG. 23; and,

FIG. 25 is an end elevation of FIG. 23.

MODES FOR CARRYING OUT THE INVENTION

Figure 1:
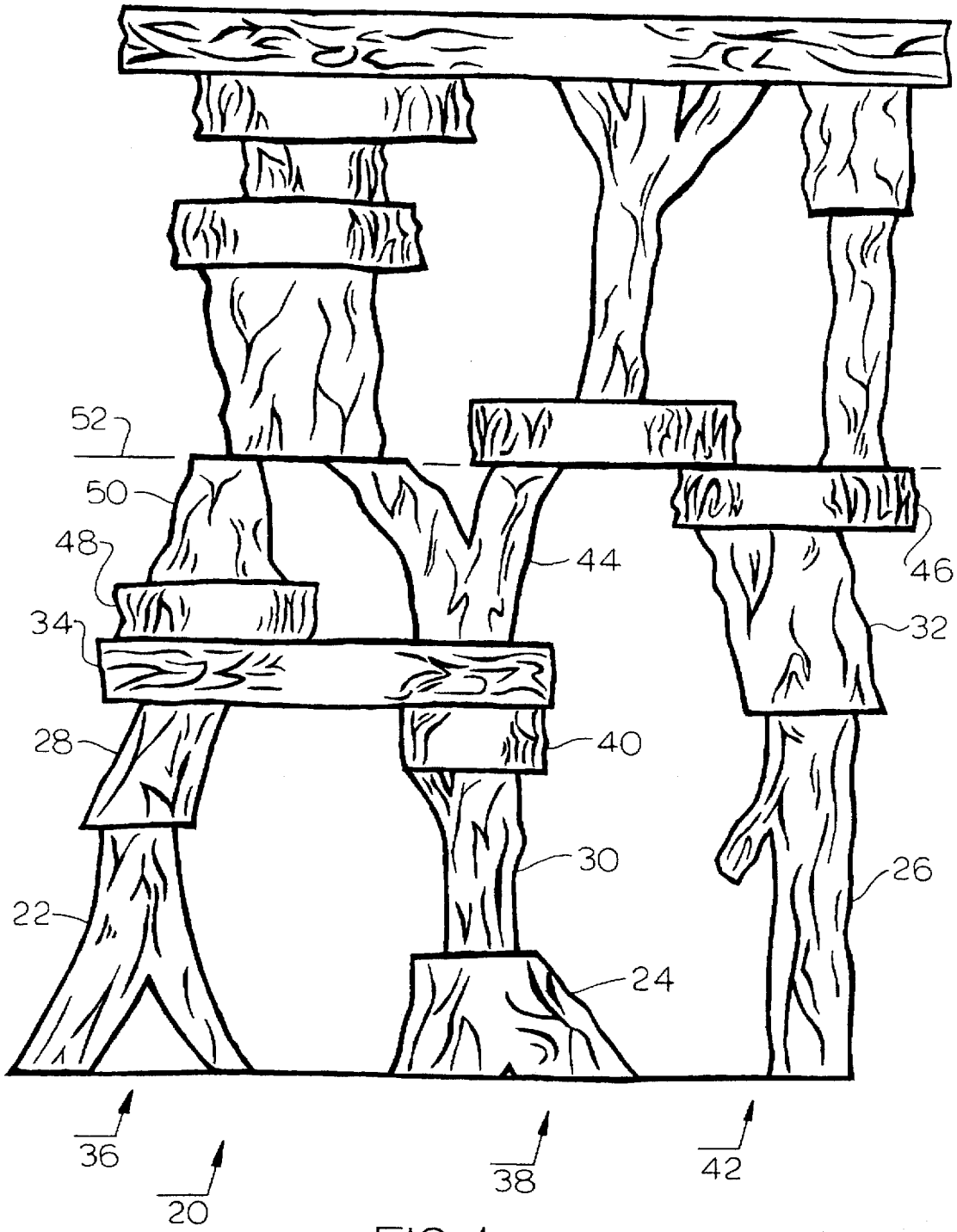
FIG. 1 is a front elevation view of a stack of tree blocks in accordance with the present invention.

Referring initially to FIG. 1, a stack of a plurality of toy blocks fabricated from pieces of small tree limbs and trunks is illustrated in accordance with the present invention, generally designated as 20. Until each piece is cut in accordance with the present invention, it is impossible to stack the blocks as shown in FIG. 1. Each block is cut with only two faces substantially parallel to each other spaced a preselected increment "I" or multiple of "I" from each other. An increment "I" of 1 centimeter has been found to be useful for blocks that are easily handled by small children. Other increments could be used such as 1 inch. All other surfaces of each block remain in their natural state. Sometimes rough edges are sanded slightly for the safety of the users.

FIG. 1 is a side elevation view of the stack 20. The individual blocks are shown more completely in the following figures. The bottom row of blocks in FIG. 1 consists of three blocks. The left block 22 is 4 cm. high, the middle block 24 is 2 cm. high, and the right block 26 is 6 cm. high. On top of the left block 22 is stacked a 2 cm. high block 28. On top of the middle block 24 is stacked a 3 cm. high block 30. And on top of the right block 26 is stacked a 3 cm. high block 32.

The columns of blocks are usually more stable if they are tied to each other. For example block 34 is a 1 cm. thick slab which is used to tie first column 36 to second column 38. However, it cannot be placed across from first column 36 to second column 38 because column 36 is 6 cm. tall while column 38 is only 5 cm. tall. The solution is to place a new block 40 having a thickness of 1 cm. on column 38 before laying slab 34 across the tops of the two. Columns 36 and 38 are now tied together. The upper level of slab 34 still does not match the upper level of third column 42. An additional block 44 having a height of 3 cm. is added to column 38. Now column 38 is taller than column 42. A block 46 having a thickness of 1 cm. is added to third column 42 to make it the same height as column 38. Now column 36 is much shorter than the other two columns. Block 48 having a thickness of 1 cm. and block 50 having a thickness of 2 cm. are placed on top of first column 36 to make it the same height as the other two columns. Now all three columns have the same height represented by the line 52—52. Additional blocks can be added to the columns as shown in FIG. 1 as desired. The only requirement is that each of the blocks is cut to have a thickness between its parallel faces of an increment "I" which in this example is 1 cm. or a multiple of "I."

Figure 2:
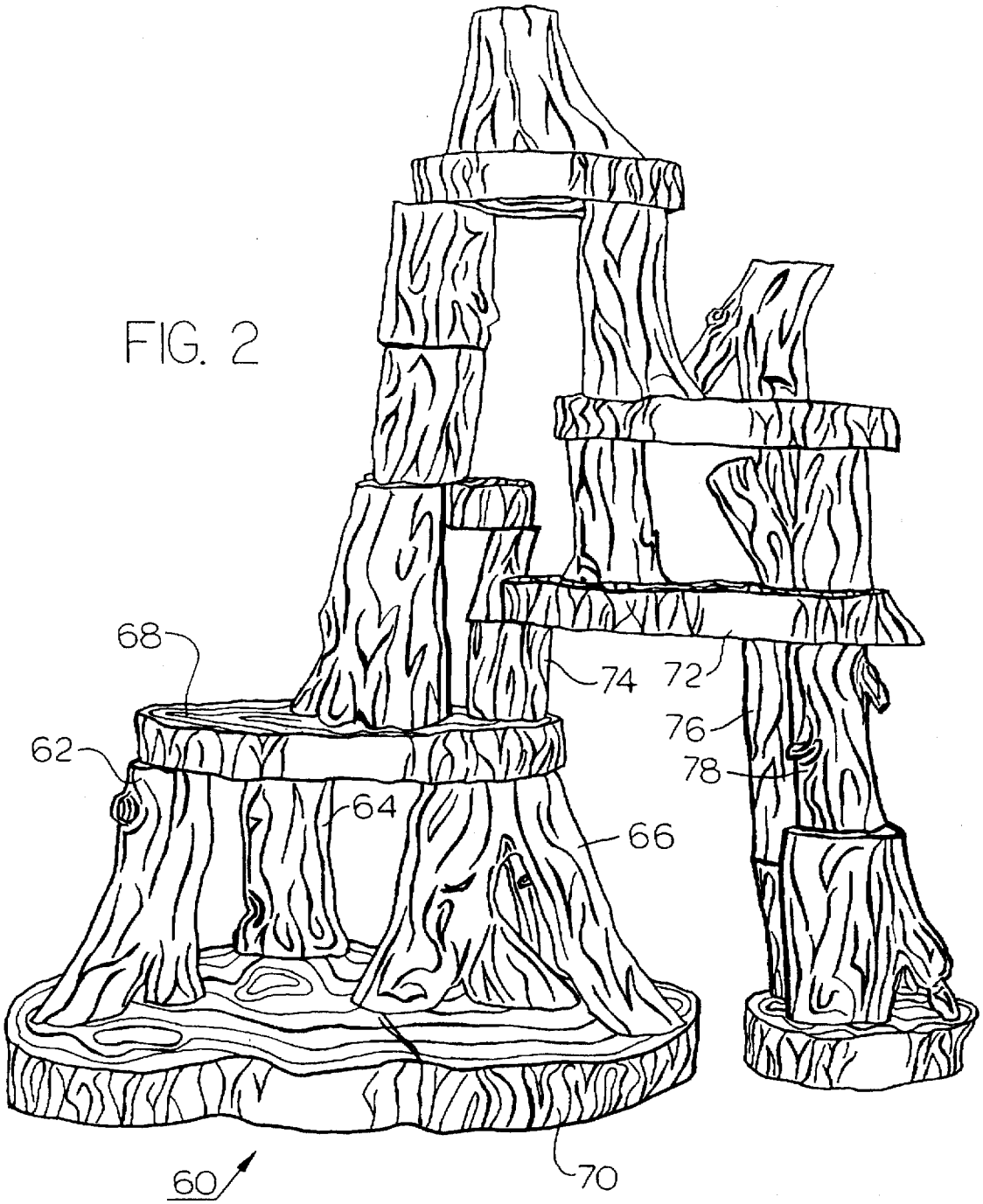
FIG. 2 is a perspective view of another stack.

FIG. 2 is a perspective view of another stack 60 and illustrates the most stable form of stack 60 having three columns 62, 64, and 66 tied together with a large disk 68. An additional large disk 70 may be used as a base where the stack 60 is constructed on a rug. Another example is disk 72 tieing together the three columns 74, 76, and 78. The three column stack is the most stable because it resists movement best in all directions. The planar stack 20 illustrated in FIG. 1 has good resistance to forces parallel to the plane of the stack but little resistance to forces perpendicular to the plane of the stack. A single column has little resistance to any forces perpendicular to the column.

Figure 3:
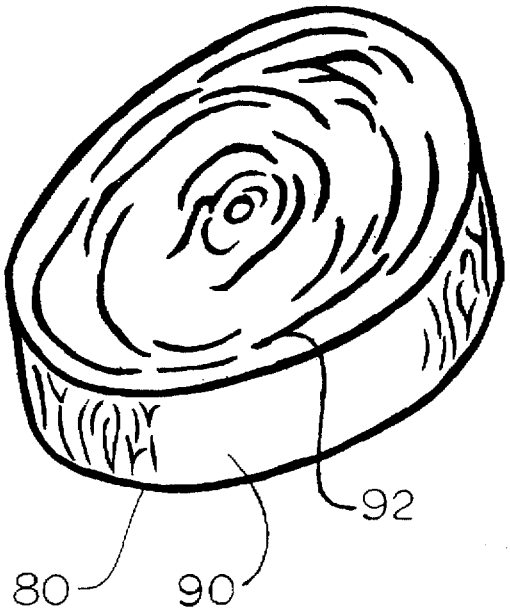
FIG. 3 is an enlarged perspective view of a disk type of block.
Figure 4:
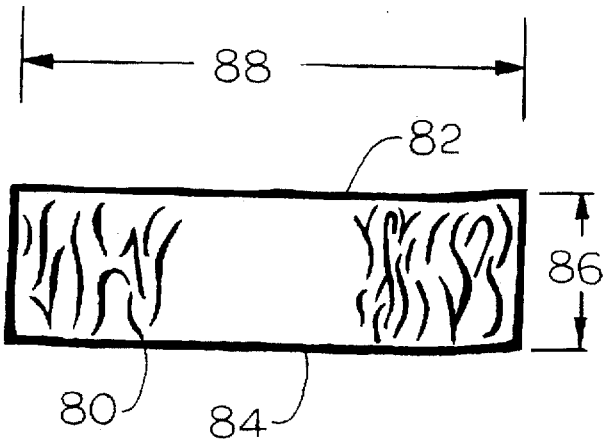
FIG. 4 is a side elevation view of FIG. 3.

FIG. 3 is an enlarged perspective view of a disk type of block 80 similar to small disks 40, 46, and 50 of FIG. 1 and large disks 68, 70, and 72 of FIG. 2. FIG. 4 is a side elevation view of disk 80. A disk type of block is a block cut substantially perpendicular to the grain of a trunk or limb of a small tree having a disk shaped configuration. The upper and lower cuts 82 and 84, respectively, are planar and substantially parallel to each other. The cuts are spaced from each other a length 86 which is equal to an increment "I" (1 cm. in FIG. 1) or a multiple of the increment "I." The length (thickness) 86 of a disk is usually less than half the diameter 88 of the disk. The bark or outer surface 90 of the disk 80 is not removed or treated in any way thereby retaining the rustic natural appearance of the disk. The larger disks cut from tree trunks are often selected to not be perfectly round and frequently have anomalies such as ingrown branches, burrs, and deadwood to add interest. The cuts 82 and 84 reveal the rings 92 of the tree trunk or branch from which the disk is cut further adding to the rustic natural appearance of the disk.

Throughout this description reference is made to the grain of the blocks. The blocks are fabricated from pieces of wood. The grain of the wood is the arrangement of the fibers or layers of the wood along a wood block. In the case of block 34 in FIGS. 3 and 4, the wood is formed in annual layers from the center to the outside as the tree grows resulting in the rings 92 when the tree is cut. The orientation of the individual wood fibers creates the grain which is in the direction of the length 86. Likewise, the natural outer surface 90 is formed by the tree with the individual wood fibers creating a grain along the outer surface in the direction of the length 86. The natural outer surface may be bark but often is not because the bark tends to fall off as the wood dries. When the tree is cut perpendicular to or across the grain of the wood, a block such as block 80 shown in FIGS. 3 and 4 is created. When the tree is cut parallel or along the grain of the wood, a block such as block 188 of FIGS. 23–25 is created. When the tree is cut an angle to the grain of the wood, a block such as block 106 of FIGS. 7 and 8 results.

These blocks can also be fabricated of plastic to have a plurality of surfaces molded to look like the natural surfaces created by a tree. The simulated grain of the plastic blocks is the same as for the natural wood blocks cut from trees. Thus, all of the FIGS. 1–25 represent plastic toy blocks as well as natural wood blocks.

Figure 5:
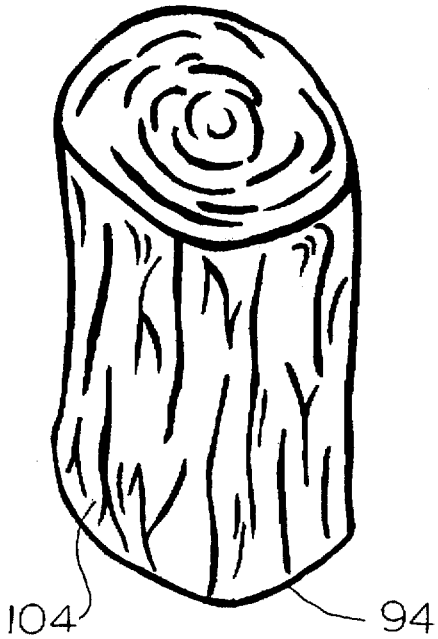
FIG. 5 is an enlarged perspective view of a cylindrical block.
Figure 6:
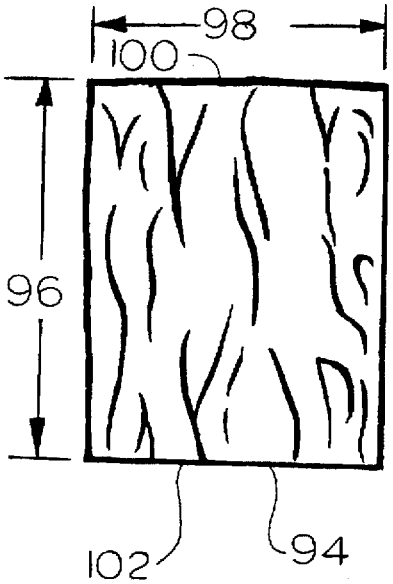
FIG. 6 is a side elevation view of FIG. 5.

FIG. 5 is an enlarged perspective view of a cylindrical block 94 similar to cylinders 26, 28, 32, and 50 of FIG. 1 and cylinders 62, 74, 76, and 78 of FIG. 2. FIG. 6 is a side elevation view of block 94. The length 96 of a cylindrical block is usually equal to or greater than its diameter 98. The upper and lower planar cut surfaces 100 and 102, respectively, are parallel to each other and are spaced an increment "I" or a multiple of increment "I" from each other. The cuts are across the grain of the wood rather than with the grain. The outer surface 104 of the cylinder 94 remains in its natural condition.

Figure 7:
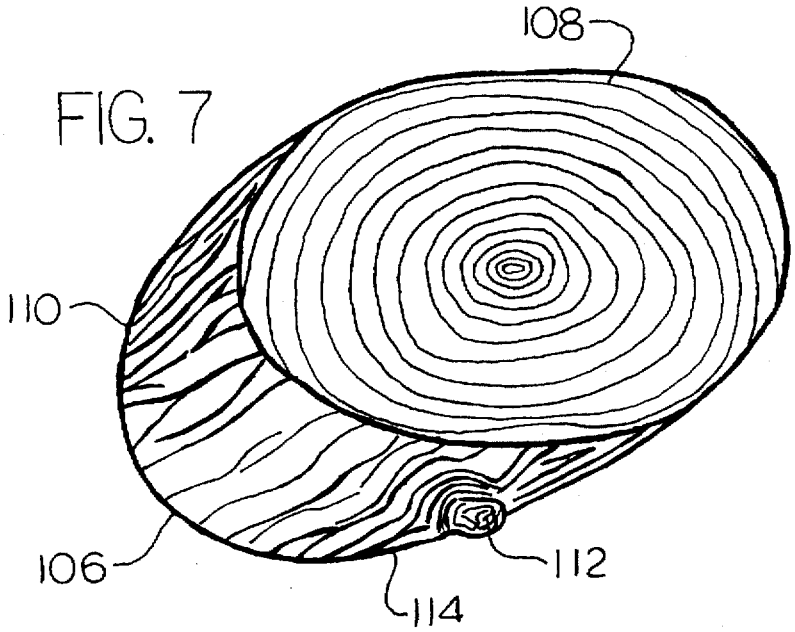
FIG. 7 is a perspective view of a cylindrical block cut at an angle that is not perpendicular to the grain of the wood.
Figure 8:
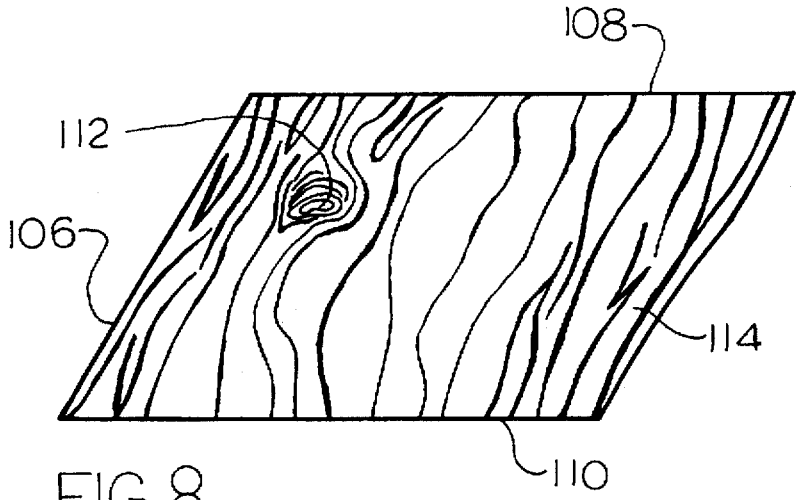
FIG. 8 is a side elevation of FIG. 7.

FIG. 7 shows a perspective view of a cylindrical block 106 cut at an angle that is not substantially perpendicular to the grain of the wood. FIG. 8 is a side elevation of cylinder 106. It is not necessary to cut the blocks perpendicular to the grain of the wood. All that is necessary is that upper and lower planar cut surfaces 108 and 110 be parallel to each other and spaced an increment "I" or a multiple of an increment "I" from each other. Cutting the tree limb at an angle creates a more interesting and challenging block. A protuberance 112 on the bark 114 adds further interest.

FIGS. 9, 10, 11, 12, 13, and 14 are other irregular variations on the cylindrical block that roughly approximate a cylinder. FIG. 9 is a side elevation view of block 116 having a curved body. FIG. 10 is a side elevation view of block 118 having a truncated cone body shape. FIG. 11 is a side elevation view of block 120 having a large protuberance 122 to one side which is for decoration only. FIG. 12 is a perspective view of block 124 which has cuts at an angle to the grain of the wood and a large protuberance 126 to one side which does not interfere with the upper and lower cuts 128 and 130. FIG. 13 is a side elevation view of block 132 which has an upper surface 134 and a large protuberance 134 and that is cut by lower cut 138. The trimmed protuberance 134 is thereby made a part of the lower cut 138 and can be used for stacking and other purposes. If block 132 is inverted, protuberance 134 functions as a cantilever or overhand. Any protuberance also alters the balance of a block and therefore also a stack. FIG. 14 is a side elevation of a cylindrical block 140 having a large side fork 142 that is primarily for decoration because the parallel cuts 144 and 146 required to stack the block do not cut across the side fork 142. If the upper cut 144 did include the side fork, then the side fork 142 could be used in conjunction with the upper surface 144 to stack the cylindrical block 140. As it is, the fork 142 must be kept structurally out of any column constructed. These decorative features also add to the play value of the blocks. For example, the protuberances extend the range of fantasy play and provide a challenge for older children who have long since discarded other blocks. All that is required for any of the cylindrical blocks shown in FIGS. 9, 10, 11, 12, 13, and 14 to be useful for stacking purposes is that the upper and lower planar cut surfaces be substantially parallel to each other and that the cuts be spaced an increment "I" or a multiple of the increment "I" from each other.

Figure 16:
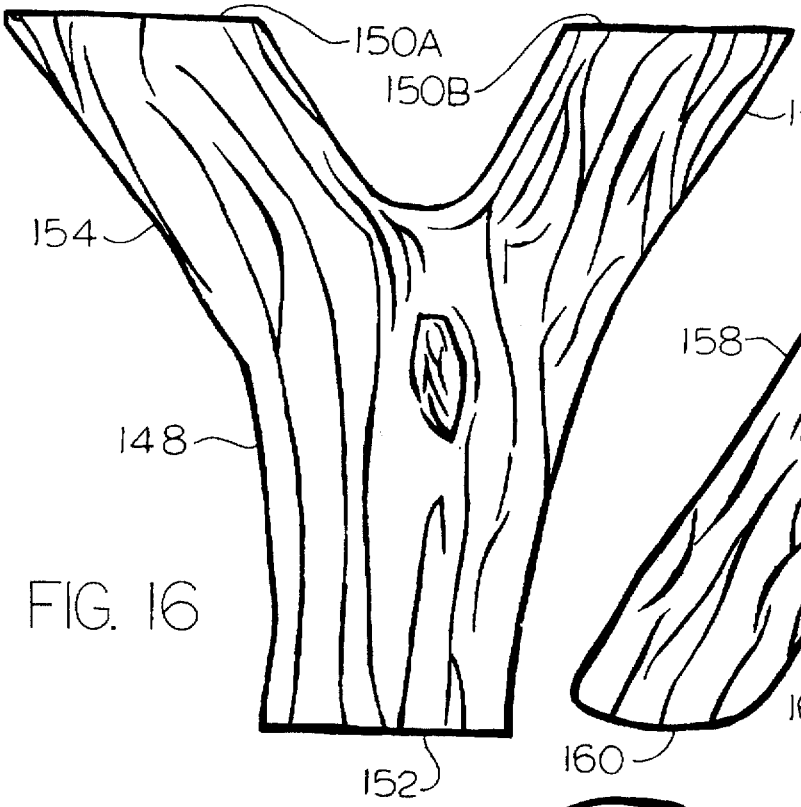
FIG. 16 is a side elevation of FIG. 15.
Figure 15:
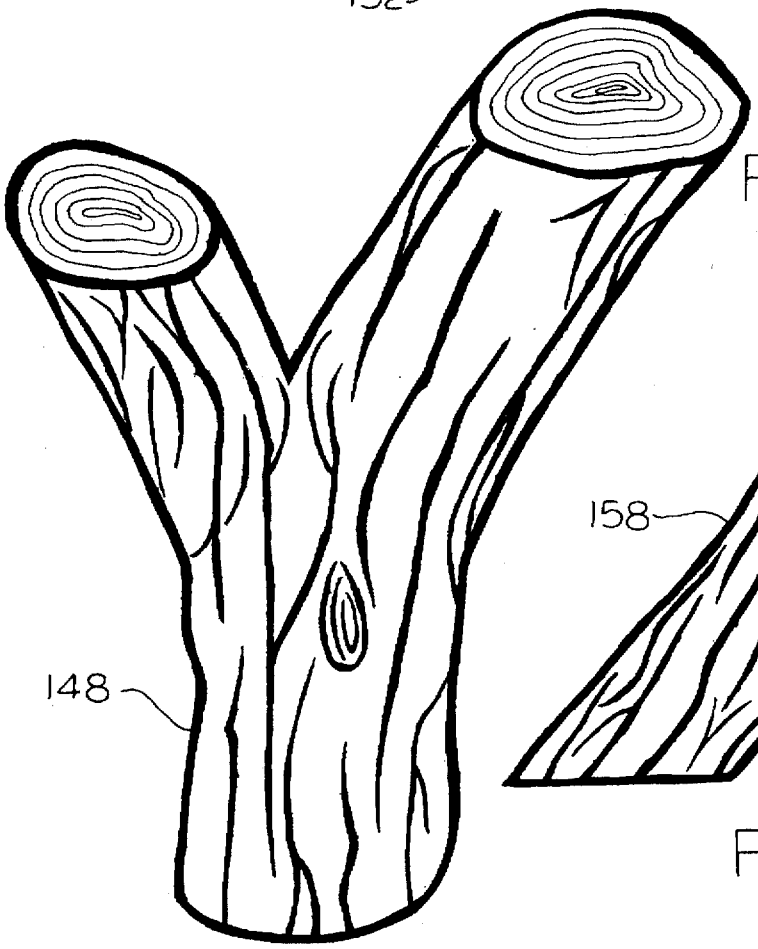
FIG. 15 is a perspective view of a forked block having two structural forks.

FIG. 15 is a perspective view of a block 148 in the shape of a fork similar to blocks 22, 30, and 44 in FIG. 1 and 62 in FIG. 2. FIG. 16 is a side elevation of forked block 148. Upper and lower planar cut surfaces 150 and 152 are parallel to each other and are spaced from each other an increment "I" or a multiple of the increment "I" Both upper surfaces 150A and 150B of the two forks 154 and 156 are available for use in a column. The two forks may also be used as supports in two different columns as occurs with forked block 44 in FIG. 1. If forked block 148 is inverted, it becomes very stable. Alternately, some forks only stand in one orientation.

Figure 17:
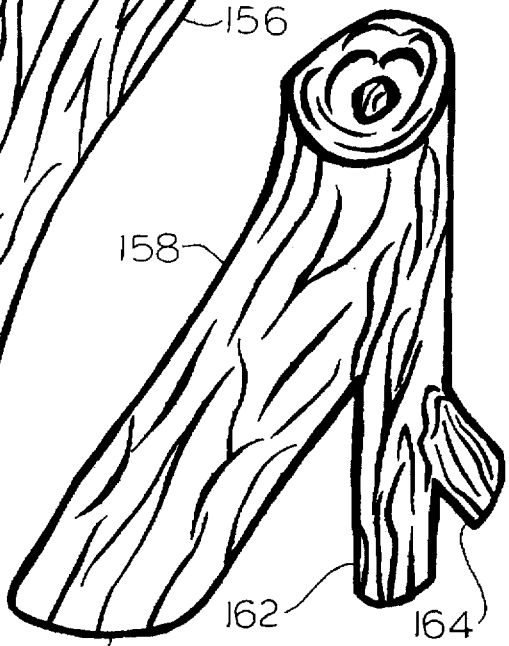
FIG. 17 is a perspective view of another forked block having two structural forks and one non-structural fork.
Figure 18:
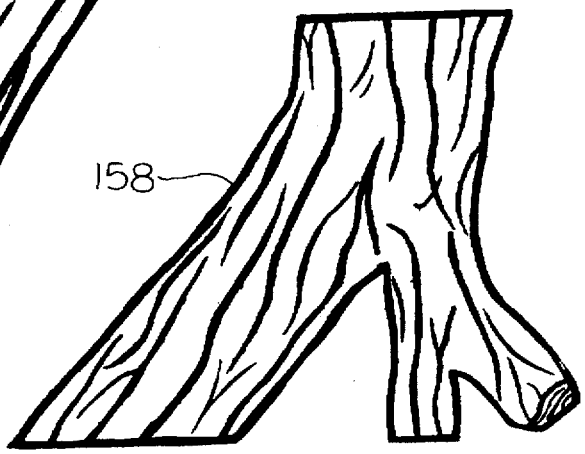
FIG. 18 is a side elevation view of FIG. 17.

FIG. 17 is a perspective view of another forked block 158 having two structural forks 160 and 162 and a non-structural or decorative third fork 164. FIG. 18 is a side elevation view of forked block 158. Forked block 158 will fall over due to the weight of fork 160 if it is inverted unless fork 162 is weighted further.

Figure 20:
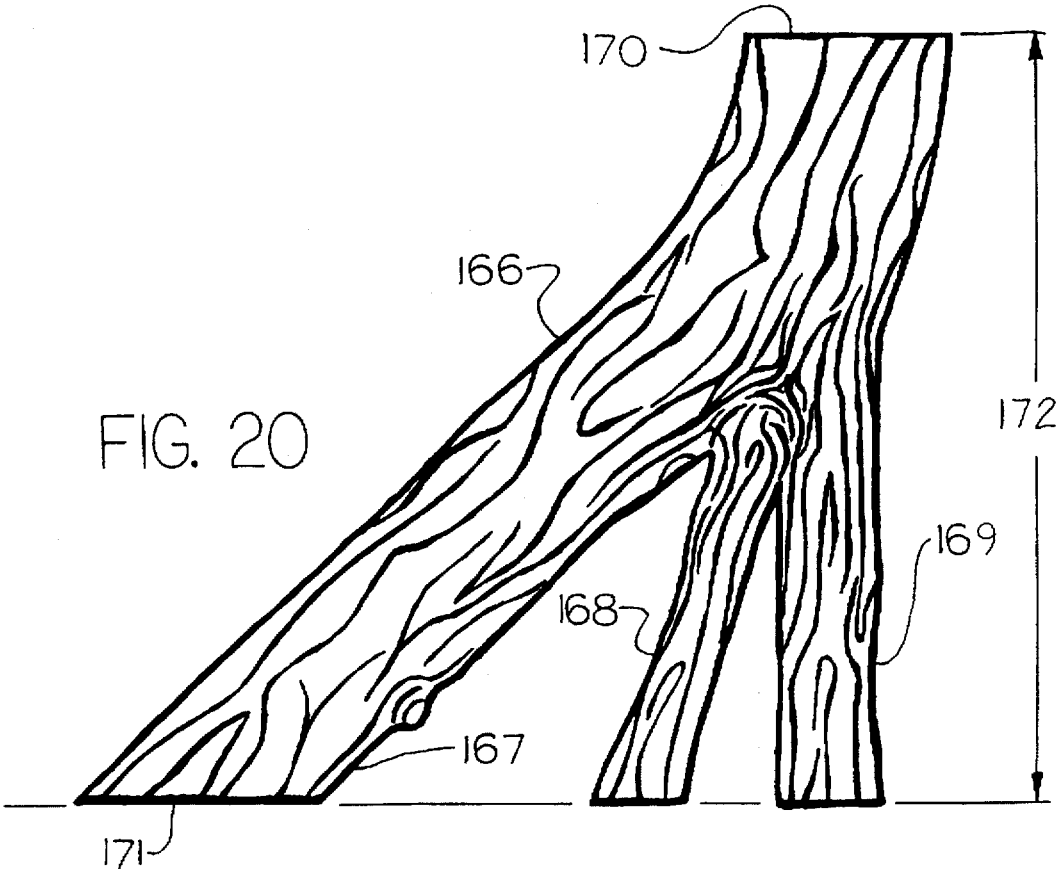
FIG. 20 is a side elevation of FIG. 19.
Figure 19:
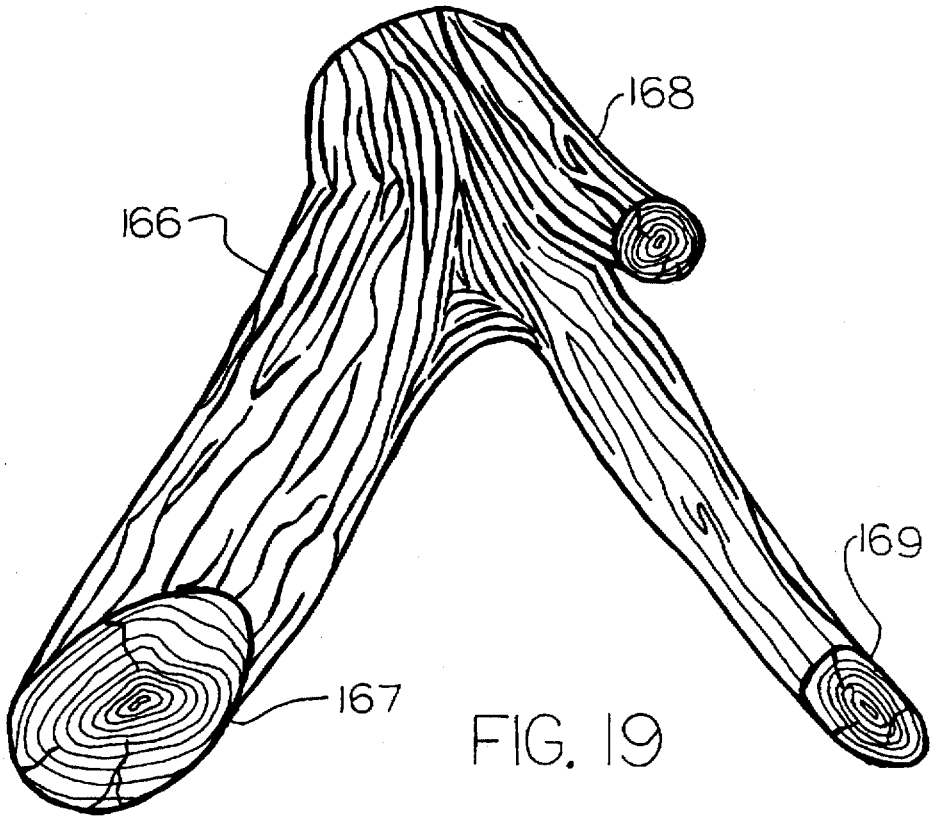
FIG. 19 is a perspective view of a forked block having three structural forks.

FIG. 19 is a perspective view of a forked block 166 having three structural forks 167, 168, and 169. FIG. 20 is a side elevation of fork 166. A more complex but similar block is block 66 in FIG. 2. The complexity of the block does not interfere with the structural use of the block for stacking purposes as long as the upper and lower planar cut surfaces 170 and 171, respectively, are parallel, cross all elements of the block, and are spaced an increment "I" or a multiple of the increment "I" from each other represented by the distance 172.

Figure 21:
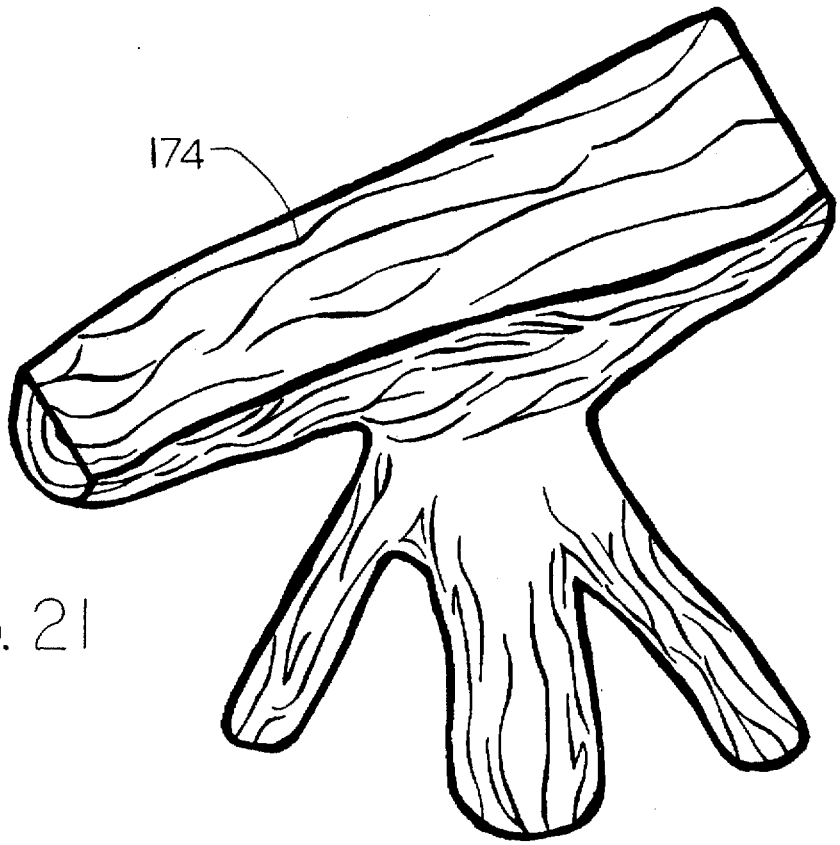
FIG. 21 is a perspective view of a forked block cut from the side of a larger limb or trunk.
Figure 22:
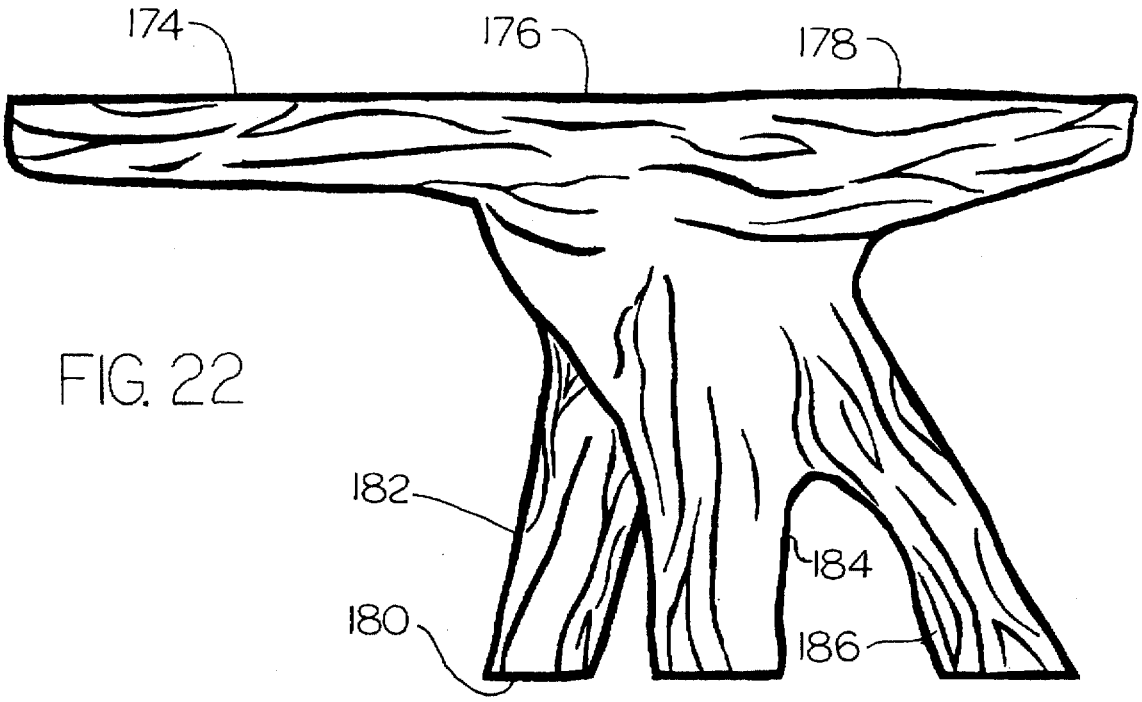
FIG. 22 is a side elevation of FIG. 21.

FIG. 21 is a perspective view of a forked block 174 cut from the side of a larger limb or trunk. FIG. 22 is a side elevation of fork 174. The upper planar cut surface 176 is along the grain of the wood of the main body 178 while the lower planar cut surface 180 is across the grain of the three forks 182, 184, and 186. (In FIGS. 15–20 the cuts are made substantially across the grain of the wood.) The complexity of the block does not affect its use as a structural element as long as it is adequately weighted and the upper and lower planar cut surfaces are parallel to each other and are spaced an increment "I" or a multiple of the increment "I" This block is an example of a block where both ends of the single surface 176 must be loaded to keep the block from tipping or the block must be inverted which changes its stability entirely.

FIG. 23 is a perspective view of a plank type of block 188. FIG. 24 is a side elevation of block 188 and FIG. 25 is an end elevation. The upper and lower planar cut surfaces 190 and 192 are along the grain of the wood, parallel to each other, and spaced from each other by an increment "I" or a multiple of "I". Block 34 in FIG. 1 is a plank type block.

The preferred embodiments of the invention described herein are exemplary and numerous modifications, dimensional variations, and rearrangements can be readily envisioned to achieve an equivalent result, all of which are intended to be embraced within the scope of the appended claims. The possibilities available are limited only by the whims of nature. In addition, all of the blocks can be molded of plastic to match the exact shapes of the natural products or for the creation of new shapes and structural balance characteristics having the general appearance of the natural products.

I claim:

1. A tree block set, comprising: at least one block fabricated from a portion of a tree and having:

a grain;

a plurality of curved natural surfaces created by said tree; and, only two planar cuts substantially parallel to each other and spaced from each other an increment "I"; and, a plurality of blocks, each of said blocks fabricated from a portion of a tree and having:

a grain;

a plurality of curved natural surfaces created by said tree; and, only two planar cuts substantially parallel to each other and spaced from each other a multiple of said increment "I".

2. A tree block set according to claim 1, wherein at least one of said plurality of blocks is a disk having: said two planar cuts substantially perpendicular to said grain of said block;

a substantially disk configuration;

a diameter; and, said two planar cuts spaced from each other less than one-half of the length of said diameter.

3. A tree block set according to claim 1, wherein at least one of said plurality of blocks is a cylinder having:

said two planar cuts substantially perpendicular to said grain of said block;

a substantially solid cylindrical configuration;

a diameter; and, said two planar cuts spaced from each other more the length of said diameter.

4. A tree block set according to claim 3, further including said curved natural surface of said cylinder having a protuberance spaced from each of said two planar cuts.

5. A tree block set according to claim 3, further including said curved natural surface of said cylinder having an uncut protuberance passing through one of said two planar cuts.

6. A tree block set according to claim 3, further including said curved natural surface of said cylinder having a protuberance cut along one of said two cuts.

7. A tree block set according to claim 1, wherein at least one of said plurality of blocks is a cylinder having:

said two planar cuts at an angle not substantially perpendicular to said grain of said block;

a substantially solid cylindrical configuration;

a diameter; and, said two planar cuts spaced from each other more than the length of said diameter.

8. A tree block set according to claim 7, further including said curved natural surface of said cylinder having a protuberance spaced from either of said two planar cuts.

9. A tree block set according to claim 7, further including said curved natural surface having an uncut protuberance passing through one of said two planar cuts.

10. A tree block set according to claim 1, wherein at least one of said plurality of blocks is a forked block having:

at least two forks; and, one of said two planar cuts cutting across both of said at least two forks.

11. A tree block set according to claim 10, further including said curved natural surface of said forked block having a protuberance spaced from either of said two planar cuts.

12. A tree block set according to claim 10 wherein said at least two forks are three forks.

13. A plastic toy block set, comprising: at least one plastic block having:

a plurality of surfaces molded to look like the curved natural surfaces created by a tree; and, planar surfaces in one of only two planes which are substantially parallel to each other and spaced from each other an increment "I" and made to look like the natural grain created when a tree is cut; and, a plurality of plastic blocks, each of said blocks having:

a plurality of surfaces molded to look like the curved natural surfaces created by a tree; and, planar surfaces in one of only two planes which are substantially parallel to each other and spaced from each other a multiple of said increment"I" and made to look like the natural grain created when a tree is cut.

14. A plastic toy block set according to claim 13, wherein at least one of said plurality of blocks is a disk having:

said two planar surfaces substantially perpendicular to said plurality of surfaces molded to look like the curved natural surfaces created by a tree;

a substantially disk configuration;

a diameter; and, said two planes spaced from each other less than one-half of the length of said diameter.

15. A plastic toy block set according to claim 13, wherein at least one of said plurality of blocks is a cylinder having:

said two planes substantially perpendicular to said plurality of surfaces molded to look like the curved natural surfaces created by a tree;

a substantially solid cylindrical configuration;

a diameter; and, said two planes spaced from each other more than the length of said diameter.

16. A plastic toy block set according to claim 15, further including said plurality of surfaces molded to look like the curved natural surfaces created by a tree having a protuberance spaced from each of said two planes.

17. A plastic toy block set according to claim 15, further including said plurality of surfaces molded to look like the curved natural surfaces created by a tree having a protuberance passing through one of said two planes.

18. A plastic toy block set according to claim 15, further including said plurality of surfaces molded to look like the curved natural surfaces created by a tree having a protuberance with a planar surface made to look like said protuberance is cut along one of said two planes.

19. A plastic toy block set according to claim 13, wherein at least one of said plurality of blocks is a cylinder having:

said two planes at an angle not substantially perpendicular to said plurality of surfaces molded to look like the curved natural surfaces created by a tree;

a substantially solid cylindrical configuration; a diameter; and, said two planes spaced from each other more than the length of said diameter.

20. A plastic toy block set according to claim 19, further including said plurality of surfaces molded to look like the curved natural surfaces created by a tree having a protuberance spaced from each of said two planes.

21. A plastic toy block set according to claim 19, further including said plurality of surfaces molded to look like the curved natural surfaces created by a tree having a protuberance passing through one of said two planes.

22. A plastic toy block set according to claim 13, wherein at least one of said plurality of blocks is a forked block having:

at least two forks; and, one of said two planes passing across both of said at least two forks.

23. A plastic toy block set according to claim 22, further including said plurality of surfaces molded to look like the curved natural surfaces created by a tree having a protuberance spaced from each of said two planes.

24. A plastic toy block set according to claim 22 wherein said at least two forks are three forks.

* * * * *